US005165682A

United States Patent [19]

McGuckin et al.

[11] Patent Number: 5,165,682

[45] Date of Patent: Nov. 24, 1992

[54] REFLEX SKILL PRACTICE DEVICE AND METHOD

[75] Inventors: James S. McGuckin, 36 Washington Street, Markham, Ontario, Canada, L3P 2R5; Alexander J. Carlisle, St. Walburg; Lawrence J. Bresson, Ganges, both of Canada

[73] Assignee: James S. McGuckin, Fulford Harbour, Canada

[21] Appl. No.: 670,945

[22] Filed: Mar. 18, 1991 (Under 37 CFR 1.47)

Related U.S. Application Data

[63] Continuation-in-part of Ser. No. 554,438, Jul. 19, 1990, abandoned, which is a continuation-in-part of Ser. No. 124,178, Nov. 24, 1987, abandoned.

[51] Int. Cl.[5] ..... A63B 69/40

[52] U.S. Cl. ..... 273/26 E

[58] Field of Search ..... 273/26 E, 58 R, 58 B, 273/58 C, 26 C, 58 A, 58 BA, 61 R, 61 A, 413, 414, 1 R, 1 G, 1 G F, 29 A

[56] References Cited

U.S. PATENT DOCUMENTS

| | | | |
|---|---|---|---|
| 2,842,366 | 7/1958 | Fant | 273/26 E |
| 3,152,537 | 10/1964 | Lewis | 273/26 E |
| 3,214,166 | 10/1965 | Gaudet | 273/26 E |
| 4,032,145 | 6/1977 | Tami | 273/26 E |
| 4,127,268 | 11/1978 | Lindgren | 273/26 E |
| 4,162,790 | 7/1979 | Kelsey et al. | 273/58 C |
| 4,186,921 | 2/1980 | Fox | 273/58 C |

FOREIGN PATENT DOCUMENTS

| | | | |
|---|---|---|---|
| 597176 | 5/1934 | Fed. Rep. of Germany | 273/58 C |

*Primary Examiner*—Theatrice Brown

[57] ABSTRACT

The present inventions relate to a method of practicing reflex skills in catching a ball rebounding from the ground wherein the method includes the use of a ball attached to one end of a resilient tether with a handle attached to the second end of the tether. The length of the tether between the ball and the handle is about 2 to 5 feet to permit the ball to be swung by a user of the device in a generally vertical circular motion and thereafter to strike the ground such that the rebound characteristic of the ball and the resiliency of the tether cooperate to cause the ball to rebound toward the user in imitation of the hop of a ball being fielded in the game of baseball.

8 Claims, 5 Drawing Sheets

REFLEX SKILL PRACTICE DEVICE AND METHOD

This application is a Continuation-in-part application of Ser. No. 07/554,438 filed Jul. 19, 1990 (now abandoned) which is a Continuation-in-part application of Ser. No. 07/124,178, filed Nov. 24, 1987, now abandoned.

FIELD OF THE INVENTION

The present invention relates generally to reflex skill development devices for use in athletic games, particularly baseball and methods for using such devices. In particular, it relates to a device and practice ball for use in a method for developing the reflex skills necessary for fielding and catching of balls in such games.

BACKGROUND OF THE INVENTION

Reflex skill development devices for practicing skills necessary in athletic games such as baseball have been known for some time. Such devices are useful for practicing among other skills, the skills necessary for batting and catching of balls in the game of baseball. For example, a batting aid is described in U.S. Pat. No. 4,577,864 to Michael A. Aldrich comprising a molded foam rubber ball secured through a braided tubular rope and an elongated wand or a handle. U.S. Pat. No. 4,032,145 to Max M. Tami discloses a spherical baseball affixed at one end of a long nylon cord with a flexible handle fastened at the opposite end and a slide control mounted between U.S. Pat. No. 3,907,287 to Fox et al, discloses a hollow, perforated, substantially rigid ball secured to one end of a tether line, the opposite end of which is spring attached to a handle through pivoting and rotating members.

Devices for practicing the reflex skills required in catching a ball are described for example, in U.S. Pat. No. 3,843,126 to Leon D. Bandy. This patent describes a catching practice device comprising a rubber ball secured to one end of a tether line, the opposite end of which is attached to a partial glove. Another catching practice device is described in U.S. Pat. No. 3,731,927 to Thomas J. Rocco Jr. showing a ball made of knotted rubber bands tethered to a glove by a stretchable elastic rubber cord.

Additionally, erratic balls have been known for some time in the art. U.S. Pat. No. 2,362,064 to Giesinger describes a balanced ball with a highly irregular external surface which rebounds erratically upon striking a surface. U.S. Pat. No. 890,920 to Newbold teaches a ball with differing diameters and planes of section which, when thrown in such a way to hit and bounce upon the ground, will return to the person throwing it.

Balls with erratic behavior in other aspects are also known as disclosed in U.S. Pat. No. 1,629,364 to Scholly which teaches a throwing play ball with an enlarged portion on one side to cause the ball to behave erratically when thrown from one person to another. U.S. Pat. No. 1,346,991 to Tatum teaches a ball with a metallic strip on its interior and a means for holding this strip to one side of the center of the ball to provide for a ball which, when rolled, returns to the person who rolled it.

SUMMARY OF THE INVENTION

In one aspect the present invention relates to a resilient hollow practice ball for producing widely varying rebound characteristics. The ball comprises a resiliently flexible cover having an outer spherical contour, the cover on the interior thereof including an integrally formed elongated thickened region disposed along a circle of the ball. The thickened region is at least twice as thick as the remainder of the cover and the peripheral edges of the thickened region provide turning or tripping edges when the ball strikes a surface on or near the peripheral edges. The cover further has a plurality of perforations therethrough on opposite sides of the thickened region to permit free flow of air into and out of the ball. The cover in regions other than the thickened region resiliently and deflatably collapses upon forced impact with a surface, the thickened region being substantially stronger than the other regions of the cover to only resiliently deform upon forced impact with a surface to produce a rebound characteristic radically different than the rebound characteristic when the other regions impact with a surface. The thickened region, the peripheral edges of the thickened region and the remainder of the cover cooperate to produce radically different magnitudes of rebounds depending upon the area of the ball in contact with a surface as well as radically varying the angle of rebound of the ball upon impact with a surface in accordance with the actual area of impact of the ball with the surface and the attitude of the thickened region with respect to the area of the ball in contact with a surface.

The present invention also provides for a reflex skill development device for use in athletic games, particularly baseball. The device comprises a rebounding ball attached to one end of a resilient tether with a means for gripping the tether in the hand attached to the second end of the tether. The length of the tether between the ball and the means for gripping the tether is preferably about 2 to 5 feet to permit the ball to be swung by a user of the device in a generally vertical circular motion and thereafter to strike the ground such that the rebound characteristic of the ball and the resiliency of the tether cooperate to cause the ball to rebound toward the user in imitation of the hop of a ball being fielded in the game of baseball.

In an aspect of the invention, the ball has properties to produce erratic rebounding behaviour such that the rebound characteristic of the ball and the resiliency of the tether cooperate to cause the ball to rebound toward the user in imitation of the bad hop of a ball being fielded in the game of baseball.

In another aspect of the invention the ball has regions of differing rebound characteristics such that the apparent retractive force of the stretched tether can be deflected depending upon the region of the ball which strikes the ground to cause the ball to return to the user influenced by the unexpected resultant force and direction as a result of the deflection of the tether and the rebound characteristics of the ball.

The present invention provides for a practice ball which is useful in development of reflex skills for use in athletic games, particularly baseball. In particular, it relates to devices for use in developing reflex skills necessary for fielding and catching of balls in such games.

BRIEF DESCRIPTION OF THE DRAWINGS

The above as well as other advantages and features of the present invention will be described in greater detail according to the preferred embodiments of the present invention in which.

DETAILED DESCRIPTION OF A PREFERRED EMBODIMENT

Figure 1:
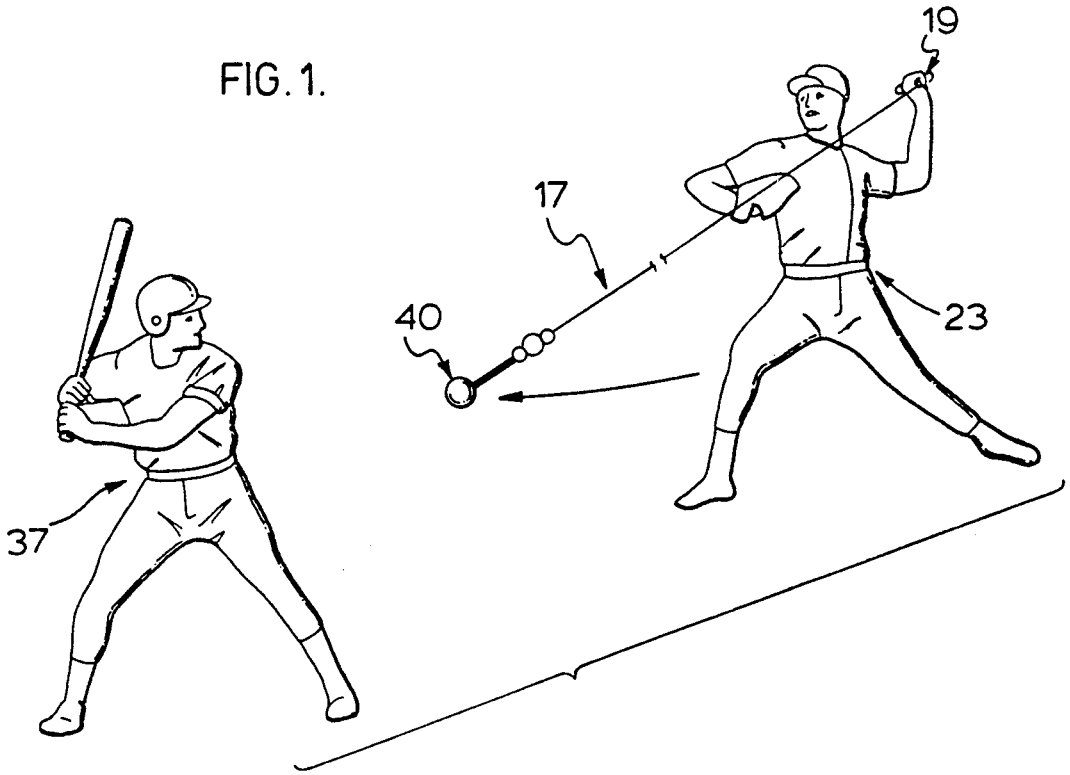
FIG. 1 is a pictorial view illustrating two athletes using the reflex skill device of the present invention in a batting practice function.
Figure 2:
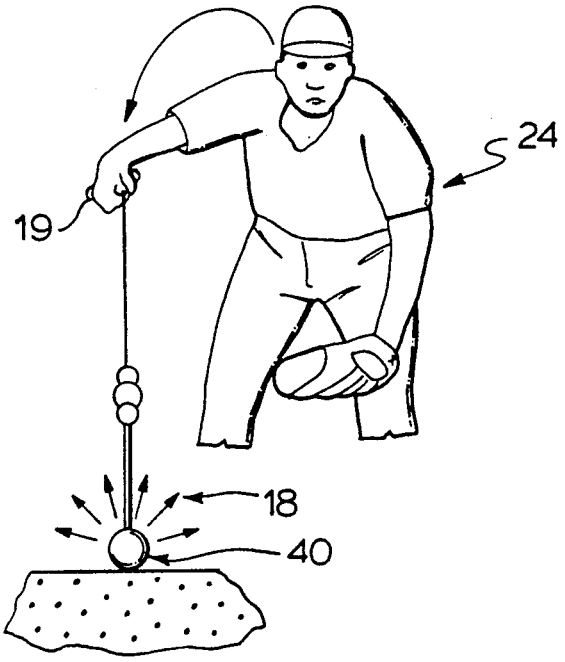
FIG. 2 is a pictorial view of an athlete utilizing the reflex skill device of the present invention on a short tether in fielding function of the present invention.

The reflex skill development device of the present invention shown generally at 18 in FIGS. 1 and 2 is useful for skill development by practicing the skills necessary for the game of baseball. In particular, as shown in FIG. 2, device 18 is useful for practicing the skills necessary for catching and fielding of ground balls. The device 18 comprises a ball 40 attached by a resilient tether 17 to a means for gripping the tether in the hand 19. The means for gripping the tether in the hand may be a loop, handle or enlargement of the tether. Preferably the means for gripping the tether in the hand is a handle. For practicing the skills necessary for fielding of a ball travelling along the ground, the operator swings the ball in a circular motion in a generally vertical plane as indicated by the arrows in FIG. 2. The swinging motion is most likened to that of a skipping rope handle. The ball 40, upon striking the ground, rebounds towards the operator 24 as a result of the co-operation of the resilient nature of the ball 40 and the resilient nature of the tether 17 as explained further hereinbelow. For practicing the skills necessary for batting of a ball, the ball is swung in a circular motion in a generally horizontal plane by a pitcher 23 to permit a batter 37 to strike the ball with a bat as shown in FIG. 1.

Figure 3:
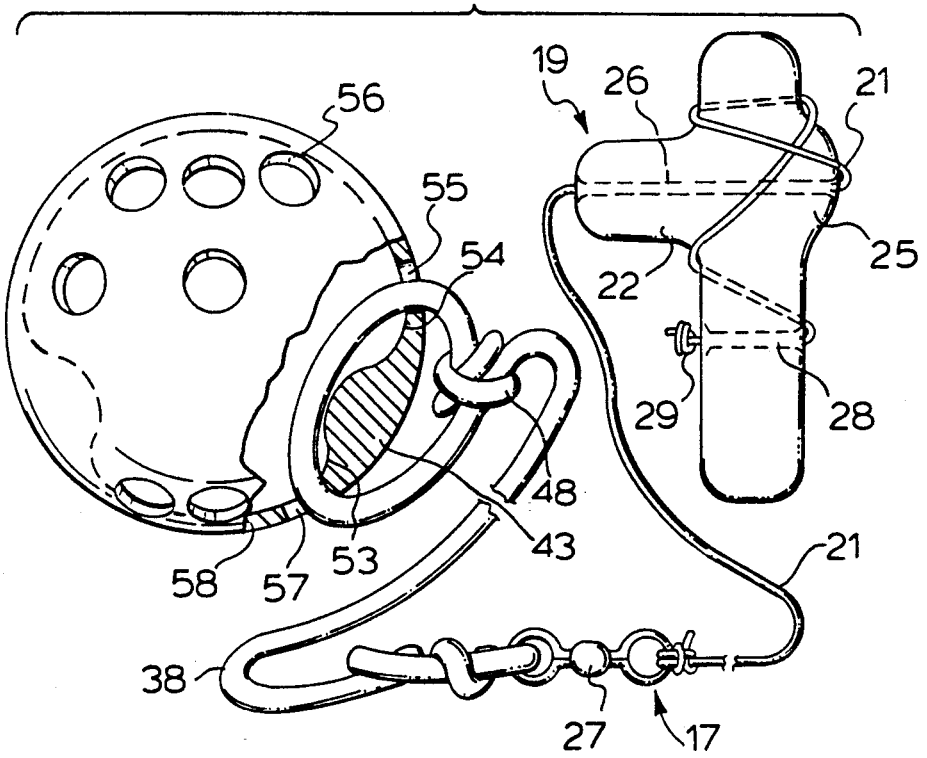
FIG. 3 is a partial cross-section of a preferred embodiment of the ball illustrating the fastening of the tether through two holes around the thickened region.
Figure 4:
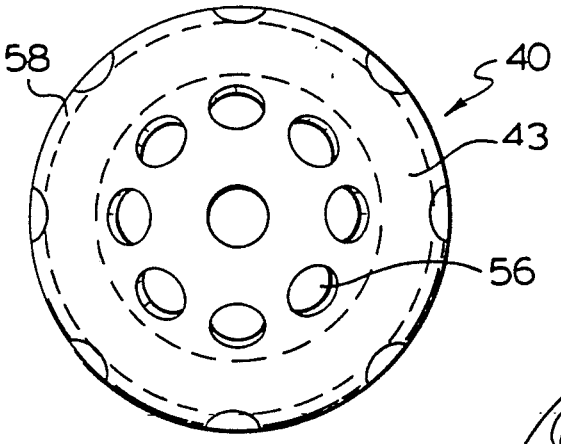
FIG. 4 is a top view of the ball of FIG. 3 with the thickened region shown by the hidden line.

One preferred embodiment of the ball of the present invention is illustrated in FIGS. 3 and 4. Ball 40 comprises a resilient cover 58 with a plurality of perforations 56 therethrough. The ball 40, in its interior, has a thickened region 43 disposed along a circle of the ball offset from the axial plane of the ball as shown by the hidden line in FIG. 4. The term "circle of the ball" refers to the circle formed on the exterior surface of the ball by the intersection of an imaginary plane which passes through the ball. Preferably, the thickened region 43 is offset from the axial plane of the ball between one fifth and one half of the radius of the ball 40, most preferably one third of the radius of the ball 40. The thickened region 43 is preferably formed integral with the cover 58 and of the same material as the cover.

The ratio of the thickness of thickened region 43 to the cover 58 is chosen depending upon the desired rebound characteristics of the ball 40. The higher the ratio of the thicknesses, the greater the differences in deformation and resilient properties of the thickened region and the remainder of the cover. The cover in regions other than the thickened region readily collapses and deflates upon forced impact with a surface, while the thickened region is substantially stronger then the other regions of the cover and only resiliently deforms upon forced impact with a surface. With the thickness of the cover in regions other than the thickened region being maintained constant, as the thickness of the thickened region is increased and hence the ratio of thicknesses is increased, the ability of the thickened region to resiliently deform is decreased and the difference between the behaviour of the thickened regions and the remainder of the cover is increased. Preferably the thickness of the cover 58 is between 0.1 and 0.5 inches and the ratio of the thickness of thickened region 43 to the cover 58 is in the range of about 2:1 to about 6:1 and most preferably in the range of about 3:1 to about 4:1.

The peripheral edges of the thickened region where it joins the other regions of the cover provide for tripping edges or turning edges as explained further hereinbelow. To increase the erratic behaviour of the ball the two peripheral edges may be constructed to have dissimilar structures. The thickened region 43 may have a top peripheral edge 54 having a slowly accelerating curve in relation to a tangent at the outside of the ball 40 and a bottom peripheral edge 53 having a faster accelerating curve in relation to a tangent at the outside of the ball. This difference in structure of the peripheral edges between the thickened region and the rest of the cover increases the erratic rebound characteristics of the ball when the ball strikes the surface at or near the peripheral edges.

Thus, when the ball 40 is tethered and used in the simulation of fielding a ball as shown in FIG. 2, the surface of the ball 40 has regions of differing collapsibility, a first region comprising the portion of the cover 58 with the band 43 and a second region comprising the portion of the cover 58 without the band. The collapsibility of the two regions of the cover noted above is directly proportional to their relative thicknesses and the number and size of the perforations provided in the cover. Additionally, if the ball strikes on or near the peripheral edge between the thickened region and the remainder of the cover, the pivoting of the ball about the edge will further influence its behaviour. Depending upon the portion of the ball 40 which strikes the ground, the ball will either rebound with a normal high rebound or will rebound low or off to the side as explained further hereinbelow.

Thickened region 43 also strengthens the cover 58 of the ball 40 at the point of attachment of the tether 17. A simple mode of attachment of tether 17 is shown in FIG. 3 where the tether is looped around the thickened region 43 by passing through perforations 55 and 57 in the cover 58. Perforation 55 and perforation 57 are on a vertical radial axial line so that tether 17 may enter ball 40 in an upper perforation 55 wrap around the thickened region 43, leave by a lower perforation 57 and be attached to itself at a point 48 external of the ball. To help withstand abrasions, the perforations 55 and 57 may be provided with rounded corners to protect the tether 17 at its point of contact with the ball 40. A light plastic sliding cover may also be provided to cover the portion of the tether passing through the perforations 55 and 57 to protect the tether against abrasions and allow the internal stretchable tether to slide in and out of the covering.

The tether 17 of the present invention is preferably constructed in two parts of two dissimilar materials. A first part 38 (also called a short tether) of short stretchable material is attached at one end to the ball 40 and then attached at a second end through a swivel arrangement 27 to a second part 21 of the tether. The short tether 38 is most preferably of a stretchable material forgiving enough to allow a stretch ratio in the range of about 3:1 to about 4:1 so that when it is of the most preferred length of about 2 to about 4 feet the tether system may stretch to approximately 7 to 10 feet. The short tether 38 is selected to have a stretch capability in the fielding function of FIG. 2 that will pull the ball back towards the operator 24 such that the ball 40 will be presented to the operator before the tether system. Additionally, in the batting function as illustrated in FIG. 1, should the batter miss the ball with the bat and strike the short tether, the tether will stretch during its wrapping around the bat such that injury to the pitcher will be prevented. An extended rubber tubing (e.g. surgical tubing) with an internal diameter of 1/16 inches and an external diameter of ¼ to 5/16 inches has been found to perform adequately. The short tether may be covered by a braided material, however the weave of such braided material should be such to allow for the required stretch capability.

The second part 21 of the tether line (also called an adjusting line) is preferably of a smaller light gauge material, most preferably multibraided nylon to keep the bulk of the fully wrapped handle of the fielding function of FIG. 2 to a minimum size to be used by athletes of all ages. The adjusting line 21 may be of any length from about 15 to about 25 feet and is most preferably about 18 feet long.

The adjusting line 21 is in turn attached to a handle 19, generally rigid in construction and manufactured from any moldable material. In the preferred embodiment the handle 19 is constructed of a smooth vulcanized rubber. All external corners of the handle 19 are rounded to prevent injury to anyone should the pitcher accidently release the handle in the batting practice function.

The adjusting line 21 passes through a first passageway 26 of the handle 19 and is attached to the handle 19 at a point on the main handgrip of the handle by looping around the handle 19 and entering a second round cornered hollow passageway 28 where it rests knotted 29 in the tapered end of second passageway 28. A raised shoulder 25 directly opposite an extension shank 22 prevents the adjusting line 21 from piling up against the opening of first passageway 26 when the line is wrapped about the handle.

Figure 7:
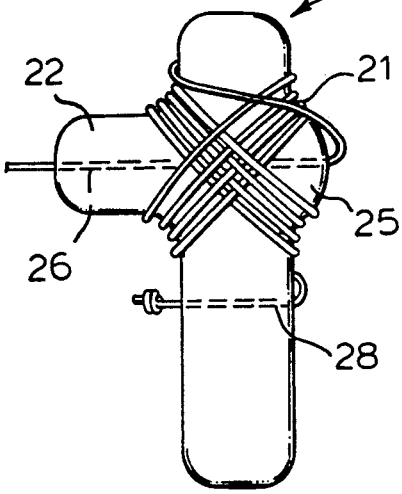
FIG. 7 is a side view of a preferred embodiment of a handle illustrating subsequent wraps of the tether around the handle.

As shown in FIG. 7 adjusting line 21 is adjustable by simply pulling it through first passageway 26 and looping around the handle 19. Thus, it is possible to adjust the total length of the tether line 17 from the short 2 to 4 feet required for the fielding practice embodiment of FIG. 2 to the longer 15 to 25 feet required in the batting practice embodiment of FIG. 1.

Figure 10:
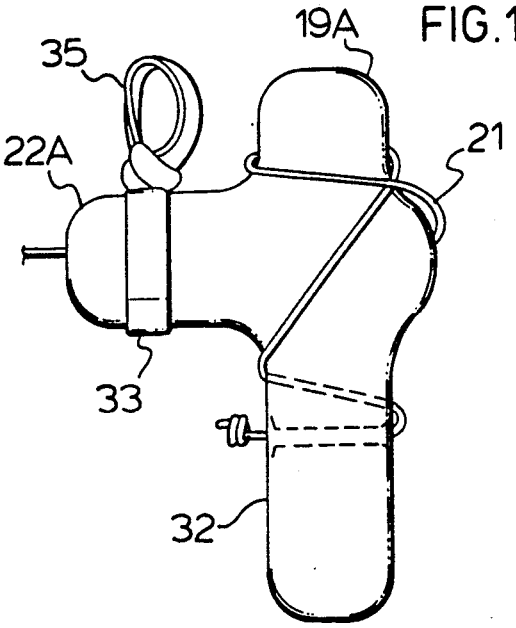
FIG. 10 is a second embodiment of a handle where an elastic band is shown on the shank of the handle illustrating the resting place of the elastic band when not in use.
Figure 11:
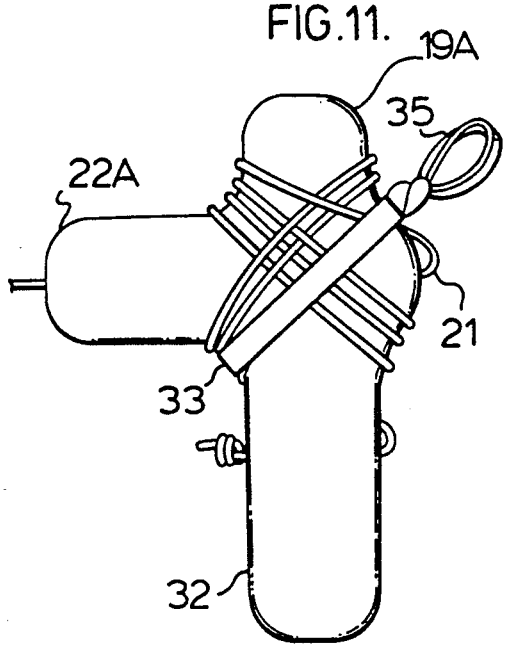
FIG. 11 is a pictorial view of the handle of FIG. 10 illustrating a function of the elastic band.

In FIGS. 10 and 11 there is a second embodiment of the handle 19A wherein the shank 22A has been extended lengthwise from the main body of the handle 32 to situate a substantially wide strong elastic band 33 with a loop 35 which lies at rest noninterfering with the clasp of the operator's hand. The band 33 when pulled over the end of the handle 19A, secures the wraps of line 21 preventing their unravelling and subsequent entanglement when not in use.

In the practice of skills required in fielding of ground balls as illustrated in FIG. 2, the device provides the required simulation of a ball bouncing along the ground due to the resilient nature of both the ball 40 and the short tether 38. As the device is swung in a generally vertical plane, the centrifugal force of the ball 40 results in stretching of the short tether 38. As the ball 40 strikes the ground, this centrifugal force causing the stretching of the tether 38 is released, thereby allowing the tether 38 to spring back to its relaxed position. The force exerted on the ball 40 by the springing back action of the tether 38 in combination with the rebound of the ball from the surface of the ground results in the ball 40 being returned to the operator and presented to the operator in advance of the tether 38.

The predictability of the rebound of the ball may be varied depending upon the nature of the ball itself. Thus, a ball having a fairly uniform rebounding characteristic will tend to rebound towards the operator at a generally 45° angle, the most common angle that the tether would present the ball to the ground, although there may be slight variations to this. If the ball is provided with properties to result in variations in its rebound characteristics, then the angle of the rebound from the ground will vary accordingly as a result of the division of the apparent trajectory of the ball while overcoming the immediate retraction force of the tether line when the ball strikes the ground. Thus, in a ball having a thickened region lying generally in the axial plane of the ball, there will be some variation to the angle of rebound of the ball depending upon the region of the cover of the ball which strikes the ground. With a ball having the thickened region offset from the axial plane resulting in an unbalanced property to the weight of the ball as well as providing different regions of rebound, the variations in the angle of rebound of the ball are increased resulting in a ball where the operator is not able to predict the exact nature of the rebound. Thus, the device of the present invention may be designed for varying skill levels. A person who is just starting to learn to catch a rebounding ball would use a ball having a fairly uniform rebound characteristics while as one's skill level increases, the degree of erratic behavior of the ball would be increased until one reached a ball which would provide maximum properties of erratic rebounding.

Figure 5:
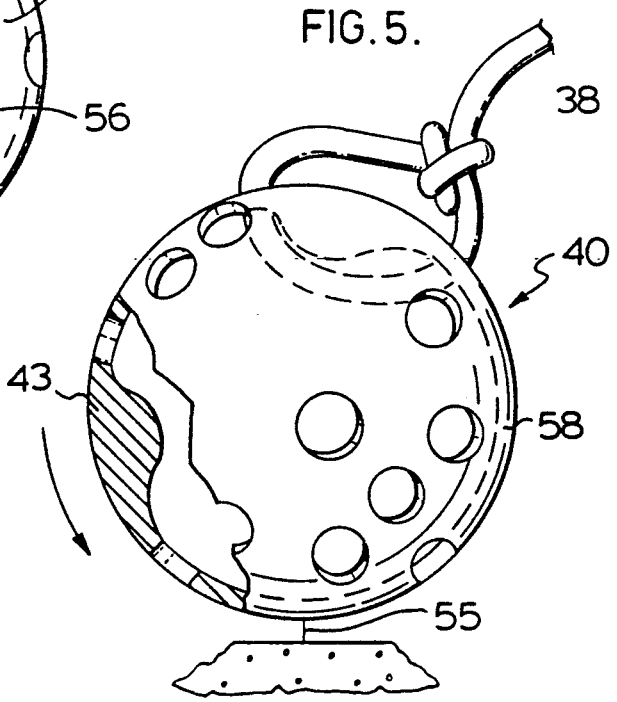
FIG. 5 is a partial cross-section side view of the ball of FIG. 3 illustrating the point of impact of the ground with the thickened region in a horizontal plane in the upper half of the ball as in a low bounce.
Figure 6:
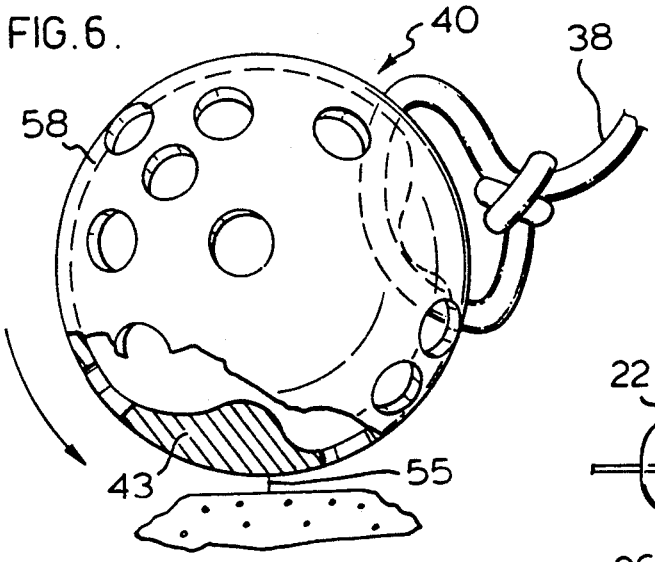
FIG. 6 is a partial cross-section of the ball of FIG. 3 illustrating the point of impact of the ground with the thickened region in the lower half of the ball as in a high bounce.

The behaviour of the ball 40 of one embodiment of the present invention when tethered is illustrated further in FIGS. 5 and 6. The ball 40, when swung in the vertical plane, generally hits the ground at reference point 55 at about a 45° angle, the most common angle that the tether 38 would present the ball 40 to the ground. The differences in the properties of relative deformation and collapse of the two portions of the cover of the ball varies such that as the ball 40 hits the ground at point 55 the rebound of the ball is dependent upon the portion of the ball striking the ground.

FIG. 5 illustrates a ball 40 where the portion of the cover without the thickened region 43 strikes the ground. The perforations provided in the cover offer little or no resistance to collapse allowing the ball to readily deflate as the cover collapses and buckles such that the ball undergoes a gyration about the peripheral edge between the thickened region and the remainder of the cover. This gyration results in the point of attachment of the tether 38 to the ball 40 being deflected downward. The combination of the forces of the collapsing of the wall of the ball resulting in a gyration of the ball; deflection of the point of attachment of the tether; and the relaxation of the stretched tether as a result of the release of the centrifugal force on the tether results in a low bounce toward the operator such that the ball would be presented to the operator at or below knee level. The peripheral edge of the thickened region upon such collapse and buckling of the cover, acts as an internal tripping or pivoting edge wherein the upper mass of the ball is top heavy and results in the gyration of the ball about the peripheral edge to direct the ball onto the deflatably collapsible perforated cover.

In FIG. 6 where the portion of the cover with the thickened region 43 strikes the ground, the cover does not collapse as readily. In this situation there is little or no gyration of the ball as it strikes the ground and hence little or no deflection of the point of attachment of the tether. In this attitude, the combination of the resilient rebound of the ball from the ground and the relaxation of the tether results in a high bounce presenting the ball to the operator at about chest level.

In both FIGS. 5 and 6, the thickened region is in a generally level attitude with respect to the point of attachment of the tether and the ground, thereby resulting in the ball rebounding directly towards the operator. As the attitude of the thickened region varies from side to side from this level with relation to the ground, the direction of rebound varies from side to side with respect to the operator. Thus, in addition to the variation in the high or low bounce of the ball as a result of the region of the cover striking the ground, the side to side variation in the bounce of the ball is also variable dependent upon the attitude of the plane of the thickened region as the ball strikes the ground.

Figure 8:
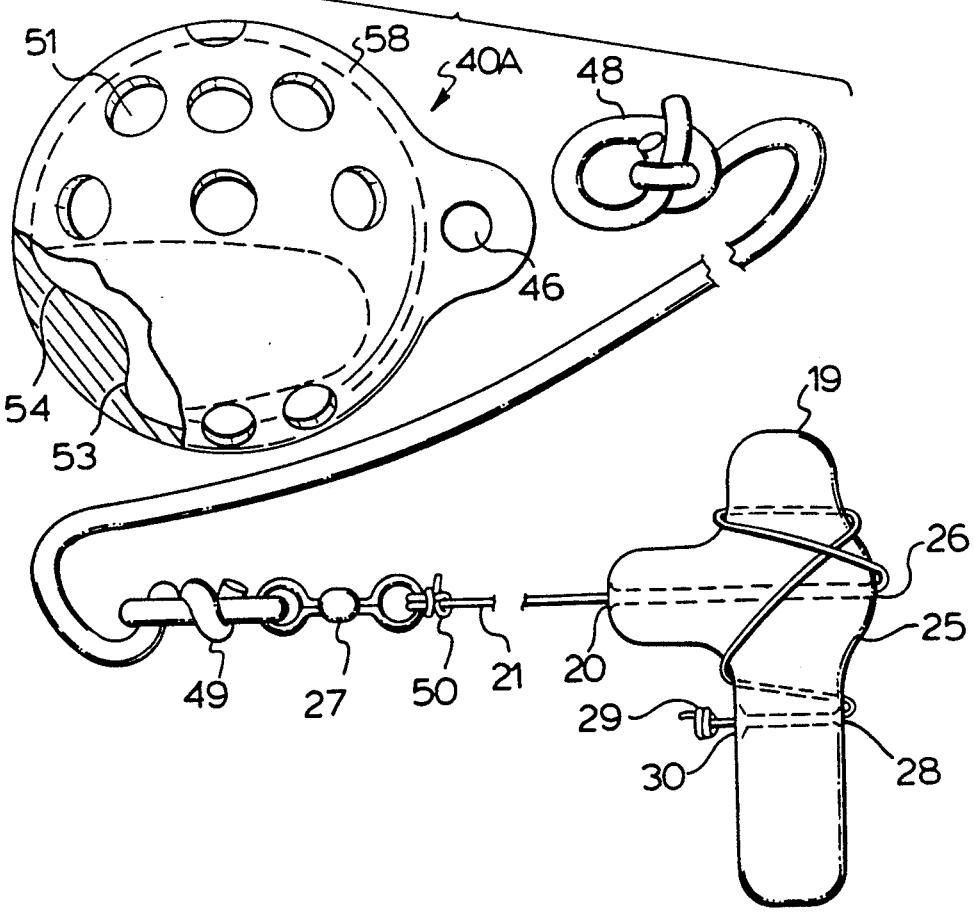
FIG. 8 is a partial cross-section side view of a second embodiment of the ball of the present invention.
Figure 9:
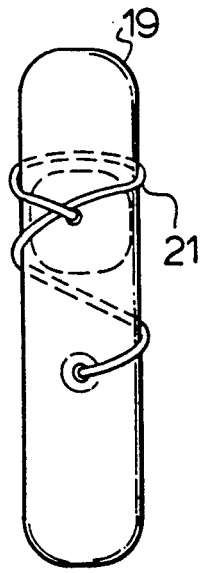
FIG. 9 is an end view of the handle of figure 7 detailing the last wrap of the cord.

FIG. 8 discloses another embodiment of the practice ball 40A wherein an attaching eye 46 is provided extending from the surface of the practice ball for attachment of the tether line. The internal structure of the ball and in particular the structure and location of the thickened region in the interior of the ball are the same as those of the embodiment of the ball as shown in FIGS. 3 to 6. The ball of the embodiment of FIG. 8 may be used in either of the functions illustrated in FIG. 1 and FIG. 2.

Figure 12:
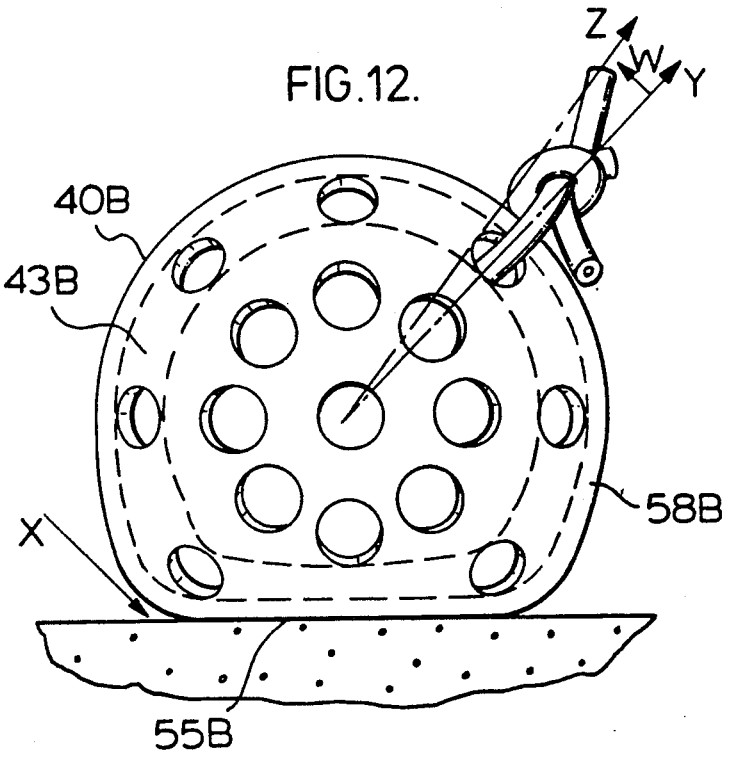
FIG. 12 is a partial cross section of a third embodiment of the ball of the present invention.
Figure 13:
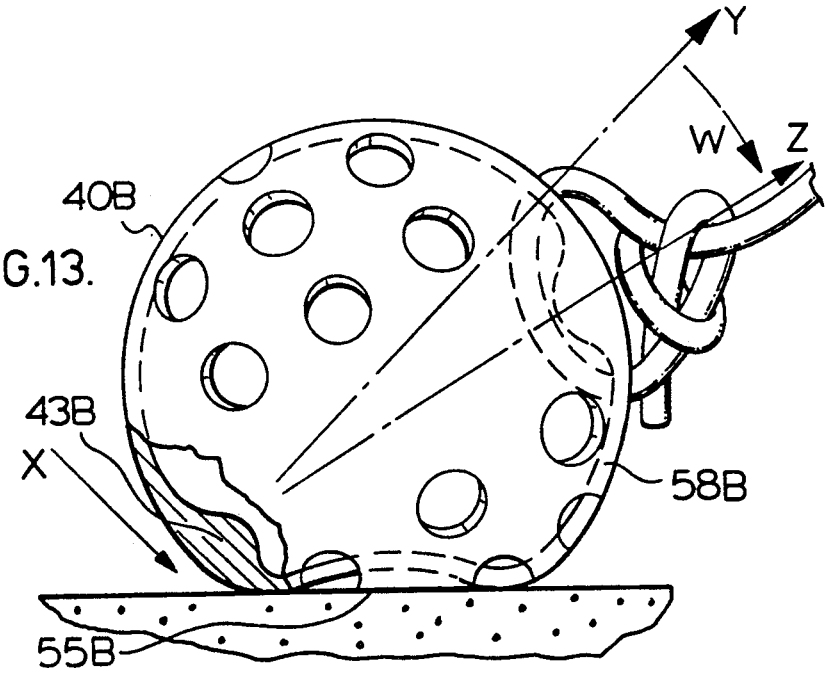
FIG. 13 is a second partial cross section of the embodiment of FIG. 12.

A third embodiment of the practice ball is shown in FIGS. 12 and 13. This ball **40*b* has a thickened region 43*b* encircling the ball disposed on the axial plane of the ball. The two peripheral edges of the thickened region 43*b* are of similar structure. In FIG. 12 a side view of the ball during a flex bounce from a surface is shown. The internal thickened region 43*b* contacts the surface at point 55*b*** with a force and direction as shown by vector X with the thickened region in a vertical attitude with respect to the surface of contact. In such an attitude, as the cover in the area of the thickened region resiliently deforms upon striking the ground, the ball will tend to take a higher return with a force and direction as shown by vector Z toward the operator as a result of the combination of the forces of the rebound of the ball from the ground and the relaxation of the stretched tether with a force and direction shown by vector Y. The force and direction of the ball as it rebounds from the surface, as shown by vector Z is slightly deflected upwards with a force and direction shown by vector W from the force and direction of the relaxation of the stretched tether due to the resilient nature of the rebound of the ball as its strikes the ground on the thickened region.

In FIG. 13 a partial cross-section view of the ball **40*b* is shown during what is termed a tripping or turning moment. The ball 40*b* strikes the ground 55*b* with a force and direction shown by vector X at or near the peripheral edge of the thickened region 43*b*. As a result of the attitude of the thickened region 43*b* with respect to the surface of the ground 55*b*, the ball 40*b* undergoes a gyration about the peripheral edge between the thickened region 43*b* and the remainder of the cover, tripping the momentum of the ball 40*b* onto the perforated region of the cover 58*b*. The perforated region of the cover 58*b* of the ball 40*b* collapses and buckles, offering little or no resistance to the gyration of the ball. This gyration results in the point of attachment of the tether 38 to the ball 40** being deflected downward with a force and direction as shown by vector W. The combination of the forces of the collapsing of the wall of the ball resulting in a gyration of the ball; deflection of the point of attachment of the tether; and the relaxation of the stretched tether as a result of the release of the centrifugal force on the tether with a force and direction shown by vector Y results in a low bounce toward the operator such that the ball would be presented to the operator at or below knee level with a force and direction shown by vector Z. The peripheral edge of the thickened region upon such collapse and buckling of the cover, acts as an internal tripping or pivoting edge wherein the upper mass of the ball is top heavy and results in the gyration of the ball about the peripheral edge to direct the ball onto the deflatably collapsible perforated cover.

As the attitude of the thickened region varies between these two positions, then the ball will, in addition to being returned in a high or low position, be returned to the operator to one side or the other, depending upon the attitude of the thickened region. Thus, the ball will tend to be returned to that side of the operator corresponding to the side of the ball where the attitude of the thickened region is at an acute angle with respect to the ground and a vertical plane stretching between the point of contact of the ball with the ground and the operator.

The behaviour of the ball as it strikes on or near the tripping edge, namely the peripheral edge of the thickened region, may be further modified by the structure of this edge. Thus if the peripheral edge of the thickened region is provided as a very sharp edge, then this will tend to accentuate the tripping or turning action of the ball as it strikes on or near this tripping edge. If the edge of the thickened region is provided as a very gradual edge, gradually reducing in thickness until it matches the thickness of the remainder of the cover, then the tripping or turning action of the ball will be less accentuated but will be spread over a larger proportion of the surface of the ball.

The behaviour of the ball upon contacting a surface is dependent upon both the area of the cover of the ball which is in contact with the surface as well as the attitude of the thickened region with respect to the point of contact of the ball with the surface. If the ball contacts the surface with the thickened region in a perfectly vertical attitude then the ball will rebound from the surface with a high bounce due to the ball resiliently deforming in areas of the thickened region. With the thickened region in a perfectly horizontal attitude with respect to the ground, the ball will rebound with a very low bounce due to the resilient collapse and deformation of the perforated region of the cover. As the attitude of the thickened region becomes less than 90° down to an attitude whereby the peripheral edge of the thickened region is in contact with the ground, there will be some gyration of the ball in the direction of the attitude of the thickened region due to the overbalancing of the ball as a result of the orientation of the thickened region. Once the attitude of the thickened region reaches the point where the peripheral edge of the ball is brought into contact with the surface either through direct contact with the surface at the point of impact of the ball or contact with the surface as a result of the collapsing of the perforated region of the ball, then the gyration of the ball due to the tripping or turning over the peripheral edge is accentuated and the rebound from the surface to that side is accentuated. Once the attitude of the thickened region is such that the peripheral edge does not come into contact with the surface either directly or indirectly, then the ball will gyrate slightly depending upon balancing of the weight of the ball as a result of the attitude of the thickened region with respect to the surface.

With the ball shown in FIGS. 5 and 6 where the thickened region is offset with respect to the axial plane of the ball, then this degree of offset will affect the behaviour of the ball such that it is dependent not only upon the attitude of the thickened region with respect to the point of contact of the ball but also the attitude of the overall balance of the ball with respect to the point of contact of the ball with the surface. Thus with an offset thickened region, the offset of the thickened region provides some imbalance to the ball even when the thickened region is in a perfectly vertical attitude and thus the predictability of the rebound of the ball is less than that of the ball with the thickened region located on the axial plane of the ball.

The ball of the present invention provides for an erratic behaviour in its rebounding upon forced impact with a surface. By tethering the ball with a resilient tether, and swinging the tethered ball in a generally vertical plane to forcibly strike a surface in front of an operator, it is possible to control the general direction of the rebound such that it rebounds towards the operator. However, due to the erratic behaviour of the ball, the actual rebound of the ball from the surface in the general direction of rebound will be erratic within certain parameters depending upon the exact structure of the ball. Additionally, the behaviour of the ball as it strikes the ground may be further accentuated depending upon the force with which it strikes the ground. Thus, increasing the velocity of the swinging action of the tether increases the centrifugal force and momentum of the ball and thereby increases behaviour of the ball upon impact with the ground and the diversion of the resultant force and direction of the rebound of the ball. For the substantial degree of diversion of the resultant force away from the apparent trajectory of the tether in the preferred embodiment, a ball with such sufficient characteristics is employed to overcome the potential retractive force of the tether during the moment of impact of the ball with the ground.

It will now be seen how the present invention provides for a practice device for developing reflex skills necessary, particularly in baseball for the fielding of ground balls.

Although various preferred embodiments of the present invention have been described herein in detail, it will be appreciated by those skilled in the art, the variations may be made thereto without departing form the spirit of the invention or the scope of the appended claims.

The embodiments of the invention in which an exclusive property or priviledge is claimed are as follows:

1. A method for practicing reflex skills required for fielding and catching of a ball comprising:

providing an apparatus comprising a rebounding ball attached to one end of a resilient tether with a means for gripping the teter in a hand attached to the second end of said tether, the length of said tether between said ball and said means for gripping the tether being about 2 to 5 feet, said ball being swung in a generally vertical circular motion by a user to cause stretching of the tether due to the centrifugal force of the ball and thereafter allowed to strike a surface in front of said user such that the rebound characteristics of said ball and the resiliency of the relaxing tether due to release of the centrifugal force of the ball cooperate to cause the ball to rebound from said surface toward the user in imitation of the hop of a ball being fielded.

2. A method as claimed in claim 1 wherein said ball comprises a resiliently flexible cover having an outer spherical contour, said cover on the interior thereof including an integrally formed thickened region disposed along a circle of the ball, said cover in regions other than said thickened region resiliently collapsing upon forced impact with said surface, said thickened region being substantially stronger than said other regions to only resiliently deform upon forced impact with said surface to produce a rebound characteristic radically different than the rebound characteristic when said other regions impact with said surface.

3. A method as claimed in claim 2 wherein said thickened region is a continuous circle about the interior of said ball.

4. A method as claimed in claim 3 wherein said cover of said ball has a plurality of perforations therethrough on opposite sides of said thickened region to permit free flow of air into and out of said ball, said cover in regions other than said thickened region resiliently and deflatably collapsing upon forced impact with said surface.

5. A method as claimed in claim 4 wherein the peripheral edges of said thickened region provide turning or tripping edges when said ball strikes said surface on or near said peripheral edges, said thickened region, said peripheral edges of said thickened region and the remainder of said cover cooperating to produce radically different magnitudes of rebounds depending upon the area of the ball in contact with said surface as well as radically varying the angle of rebound of said ball upon impact with said surface in accordance with the actual area of impact of the ball with said surface and the attitude of said thickened region with respect to the area of the ball in contact with said surface.

6. A method as claimed in claim 5 wherein said tether line is attached to said ball at the center of said thickened region.

7. A method as claimed in claim 6 wherein said tether is attached to said ball by passing through a first perforation looping about said thickened region passing through a second perforation and being connected to itself at the exterior of said ball.

8. A method as claimed in claim 7 wherein the point of attachment of said tether with said ball can be deflected as said ball strikes said surface to interrupt the immediate apparent force of retraction of said tether, the direction of the deflection of said point of attachment of said tether being dependent upon the area of the ball in contact with said surface such that the direction of recovery of said tether and direction and magnitude of rebound of said ball from said surface is dependent upon the area of the ball in contact with said surface and the the direction of the deflection of said point of attachment of said tether.

* * * * *